US010769888B2

(12) United States Patent
You et al.

(10) Patent No.: US 10,769,888 B2
(45) Date of Patent: Sep. 8, 2020

(54) DIFFERENTIATED AGGREGATION MECHANISM FOR AWARD PROVISIONING

(71) Applicant: Bally Gaming, Inc., Las Vegas, NV (US)

(72) Inventors: Qin You, Randwick (AU); Peter Wilkins, Curl Curl (AU); George Napoleon Bouvier, Henderson, NV (US); Yanhua Yin, Newington (AU); Andrew Rich, Wombarra (AU)

(73) Assignee: SG Gaming, Inc., Las Vegas, NV (US)

( * ) Notice: Subject to any disclaimer, the term of this patent is extended or adjusted under 35 U.S.C. 154(b) by 91 days.

(21) Appl. No.: 16/100,551

(22) Filed: Aug. 10, 2018

(65) Prior Publication Data

US 2019/0102992 A1 Apr. 4, 2019

Related U.S. Application Data

(60) Provisional application No. 62/565,806, filed on Sep. 29, 2017.

(51) Int. Cl.
*G07F 17/32* (2006.01)
*G07F 17/34* (2006.01)

(52) U.S. Cl.
CPC ..... *G07F 17/3258* (2013.01); *G07F 17/3213* (2013.01); *G07F 17/34* (2013.01)

(58) Field of Classification Search
USPC ..... 463/16–20
See application file for complete search history.

(56) References Cited

U.S. PATENT DOCUMENTS

| | | | |
|---|---|---|---|
| 3,733,075 | A | 5/1973 | Hooker et al. |
| 5,342,047 | A | 8/1994 | Heidel et al. |
| 5,356,140 | A | 8/1994 | Dabrowski et al. |
| 5,393,061 | A | 2/1995 | Manship et al. |
| 5,704,835 | A | 1/1998 | Dietz, II |
| 5,833,537 | A | 11/1998 | Barrie |
| 5,951,397 | A | 9/1999 | Dickinson |
| 6,056,642 | A | 5/2000 | Bennett |
| 6,641,477 | B1 | 11/2003 | Dietz, II |
| 6,910,962 | B2 | 6/2005 | Marks et al. |
| 7,018,293 | B2 | 3/2006 | Brown et al. |
| 7,029,396 | B2 | 4/2006 | Jaffe et al. |
| 7,503,847 | B2 | 3/2009 | Baerlocher |
| 7,553,231 | B2 | 6/2009 | Rodgers et al. |
| 7,604,538 | B2 | 10/2009 | Pacey |
| 8,083,581 | B2 | 12/2011 | Marks et al. |
| 8,105,151 | B2 | 1/2012 | Caputo et al. |
| 8,162,741 | B2 | 4/2012 | Wadleigh et al. |
| 8,192,275 | B2 | 6/2012 | Aoki et al. |
| 8,287,357 | B2 | 10/2012 | Evans |
| 8,323,091 | B2 | 12/2012 | Frank et al. |
| 8,357,041 | B1 | 1/2013 | Saunders |
| 8,360,851 | B2 | 1/2013 | Aoki et al. |

(Continued)

FOREIGN PATENT DOCUMENTS

| | | | |
|---|---|---|---|
| AU | 2015210489 | A1 | 2/2016 |
| GB | 2097160 | B | 5/1984 |

(Continued)

*Primary Examiner* — Michael A Cuff

(57) ABSTRACT

A gaming system includes electronic components that implement a value-aggregation procedure for displaying, combining, and awarding credit values in a reel-spinning venue.

20 Claims, 16 Drawing Sheets

(56) References Cited

U.S. PATENT DOCUMENTS 8,366,538 B1 2/2013 Saunders et al.
8,371,930 B1 2/2013 Saunders et al.
8,414,380 B2 4/2013 Saunders et al.
8,465,358 B2 6/2013 Kemper
8,496,522 B2 7/2013 Caputo
8,512,138 B2 8/2013 Saunders
8,523,659 B2 9/2013 Evans
8,574,059 B2 11/2013 Rodgers et al.
8,608,545 B2 12/2013 Arora et al.
8,662,986 B2 3/2014 Rodgers et al.
8,690,660 B2 4/2014 Saunders et al.
8,790,169 B2 7/2014 Saunders
8,851,974 B2 10/2014 Caputo et al.
8,870,642 B2 10/2014 Leupp et al.
8,882,578 B2 11/2014 Saunders
8,961,291 B2 2/2015 Dias Pires et al.
9,005,022 B2 4/2015 Saunders
9,165,433 B2 10/2015 Caputo
9,230,410 B2 1/2016 Saunders et al.
9,245,421 B2 1/2016 Saunders et al.
9,251,667 B2 2/2016 Marks et al.
9,257,017 B2 2/2016 Saunders et al.
9,262,895 B2 2/2016 Rodgers et al.
9,275,524 B2 3/2016 Nicely
9,299,224 B2 3/2016 Leupp
9,311,781 B2 4/2016 Edwards
9,349,251 B2 5/2016 Caputo et al.
9,355,528 B2 5/2016 Nicely
9,418,521 B1 * 8/2016 Henrick ..... G07F 17/34
9,424,720 B2 8/2016 Suda
9,928,691 B2 3/2018 Olive
10,037,651 B2 7/2018 You et al.
10,339,761 B2 7/2019 Olive
10,388,112 B2 8/2019 You et al.
2002/0119818 A1 * 8/2002 Savio ..... G07F 17/32
463/20
2003/0216165 A1 11/2003 Singer et al.
2004/0137982 A1 7/2004 Cuddy et al.
2006/0189369 A1 8/2006 Taylor
2007/0060248 A1 3/2007 Rodgers et al.
2007/0129135 A1 6/2007 Marks et al.
2008/0003278 A1 1/2008 Mondelo
2008/0004532 A1 1/2008 Rubey et al.
2008/0032784 A1 2/2008 Englman
2008/0045298 A1 2/2008 Yoshizawa
2008/0045320 A1 2/2008 Kato
2008/0108431 A1 5/2008 Cuddy et al.
2009/0239634 A1 9/2009 Nguyen
2009/0291741 A1 11/2009 Schofield
2010/0075737 A1 3/2010 Bluemel
2010/0167815 A1 * 7/2010 Gagner ..... G07F 17/32
463/25
2010/0234092 A1 9/2010 Gomez et al.
2010/0304832 A1 * 12/2010 Kup-Ferroth ..... G07F 17/32
463/20
2012/0122532 A1 5/2012 Berman et al.
2012/0178517 A1 7/2012 Montenegro et al.
2014/0014186 A1 1/2014 Bhattacharya et al.
2014/0141860 A1 5/2014 Meyer
2014/0179396 A1 * 6/2014 Aoki ..... G07F 17/3267
463/20
2014/0274292 A1 9/2014 Suda
2014/0323198 A1 10/2014 Tuck
2015/0170462 A1 6/2015 Berman et al.
2015/0269809 A1 * 9/2015 Smith ..... G07F 17/3213
463/20
2015/0287269 A1 10/2015 Berman
2015/0356833 A1 * 12/2015 Aoki ..... G07F 17/34
463/20
2016/0042597 A1 2/2016 Olive
2017/0154498 A1 6/2017 Olive
2018/0268655 A1 9/2018 Olive
2018/0268659 A1 9/2018 Chesworth et al.

FOREIGN PATENT DOCUMENTS

GB 2144568 B 9/1985
GB 2251112 A 6/1992

* cited by examiner

DIFFERENTIATED AGGREGATION MECHANISM FOR AWARD PROVISIONING

RELATED APPLICATION

This patent application claims the priority benefit of U.S. Provisional Patent Application Ser. No. 62/565,806 filed Sep. 29, 2017, the contents of which is incorporated herein by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2017, Bally Gaming, Inc.

FIELD OF THE INVENTION

The present invention relates generally to gaming systems, apparatus, and methods and, more particularly, to innovative value-aggregation processes that operate in conjunction with symbol-bearing reels on electronic display devices.

BACKGROUND OF THE INVENTION

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation.

Another significant technical challenge is to improve the operation of gaming apparatus and games played thereon by increasing processing speed and efficiency of usage of processing and/or memory resources. To make games more entertaining and exciting, they often offer the complexities of advanced graphics and special effects, multiple bonus features with different game formats, and multiple random outcome determinations per feature. The game formats may, for example, include picking games, reel spins, wheel spins, and other arcade-style play mechanics. Inefficiencies in processor execution of the game software can slow down play of the game and prevent a player from playing the game at their desired pace.

As the industry matures, the creativity and ingenuity required to improve such operation of gaming apparatus and games grows accordingly.

SUMMARY OF THE INVENTION

According to one aspect of the present invention, a gaming system with differential symbol-value aggregation features includes a gaming machine primarily configured to conduct a casino wagering game, the gaming machine including an electronic display device, and logic circuitry. The logic circuitry is configured to direct the electronic display device to display an array of individual symbol positions populated by independent symbol-bearing reels, a subset of the symbol positions containing a plurality of first symbols, hold the plurality of first symbols in the array while spinning at least one of the reels in the remaining symbol positions of the array, and stop the at least one spinning reel to display one or more additional symbols in the array.

The logic circuitry is further configured to, in response to the one or more additional symbols including a first aggregating symbol, add a sum of values of a first set of currently displayed symbols to the first aggregating symbol. The first set of the currently displayed symbols is determined according to first criteria. Also, the logic circuitry is configured to, in response to the one or more additional symbols including a second aggregating symbol, add a sum of values of a second set of the currently displayed symbols to the second aggregating symbol. The second set of the currently displayed symbols is determined according to second criteria. The gaming system may be incorporated into a single, freestanding gaming machine.

According to another aspect of the invention, a method of differential symbol-value aggregation on a gaming machine includes directing, by logic circuitry, an electronic display device to display an array of individual symbol positions populated by independent symbol-bearing reels. In the array of individual symbol position, a subset of the symbol positions contains a plurality of first symbols. The method further includes directing, via the logic circuitry, the electronic display device to hold the plurality of first symbols in the array while spinning at least one of the reels in the remaining symbol positions in the array, and stopping, via the logic circuitry, the at least one spinning reel to display one or more additional symbols in the array.

The method includes, in response to the one or more additional symbols including a first aggregating symbol, adding, via the logic circuitry, a sum of values of a first set of currently displayed symbols to the first aggregating symbol. The first set of the currently displayed symbols is determined according to first criteria. And also, in response to the one or more additional symbols including a second aggregating symbol, adding, via the logic circuitry, a sum of values of a second set of the currently displayed symbols to the second aggregating symbol. The second set of the currently displayed symbols is determined according to second criteria.

According to yet another embodiment of the invention, a gaming system with differential symbol-value aggregation features includes a gaming machine primarily dedicated to playing a casino wagering game, the gaming machine including an input device and an electronic display device and game-logic circuitry. The game-logic circuitry is configured to detect, via the input device, a physical item associated with a monetary value that establishes a credit balance on the gaming machine, and initiate, responsive to an input indicative of a wager drawn on the credit balance, a base game of the casino wagering game on the gaming machine. The game-logic circuitry is also configured to direct the electronic display device to display a base array of symbols on symbol-bearing reels, the base array including a plurality of triggering symbols. In response to displaying the plurality of triggering symbols in the base array, the game-logic circuitry is configured to display a bonus array of individual symbol positions populated by independent symbol-bearing reels including the plurality of triggering symbols, hold the plurality of triggering symbols in the bonus array while spinning at least one of the remaining independent symbol-bearing reels, and stop the at least one spinning independent symbol-bearing reel to display one or more additional symbols.

The game-logic circuitry is further configured to, in response to the one or more additional symbols including a first aggregating symbol, add a sum of values of a first set of currently displayed symbols to the first aggregating symbol. The first set of the currently displayed symbols is determined according to first criteria. In response to the one or more additional symbols including a second aggregating symbol, the game-logic circuitry is also configured to add a sum of values of a second set of the currently displayed symbols to the second aggregating symbol. The second set of the currently displayed symbols is determined according to second criteria.

Additional aspects of the invention will be apparent to those of ordinary skill in the art in view of the detailed description of various embodiments, which is made with reference to the drawings, a brief description of which is provided below.

Figure 1:
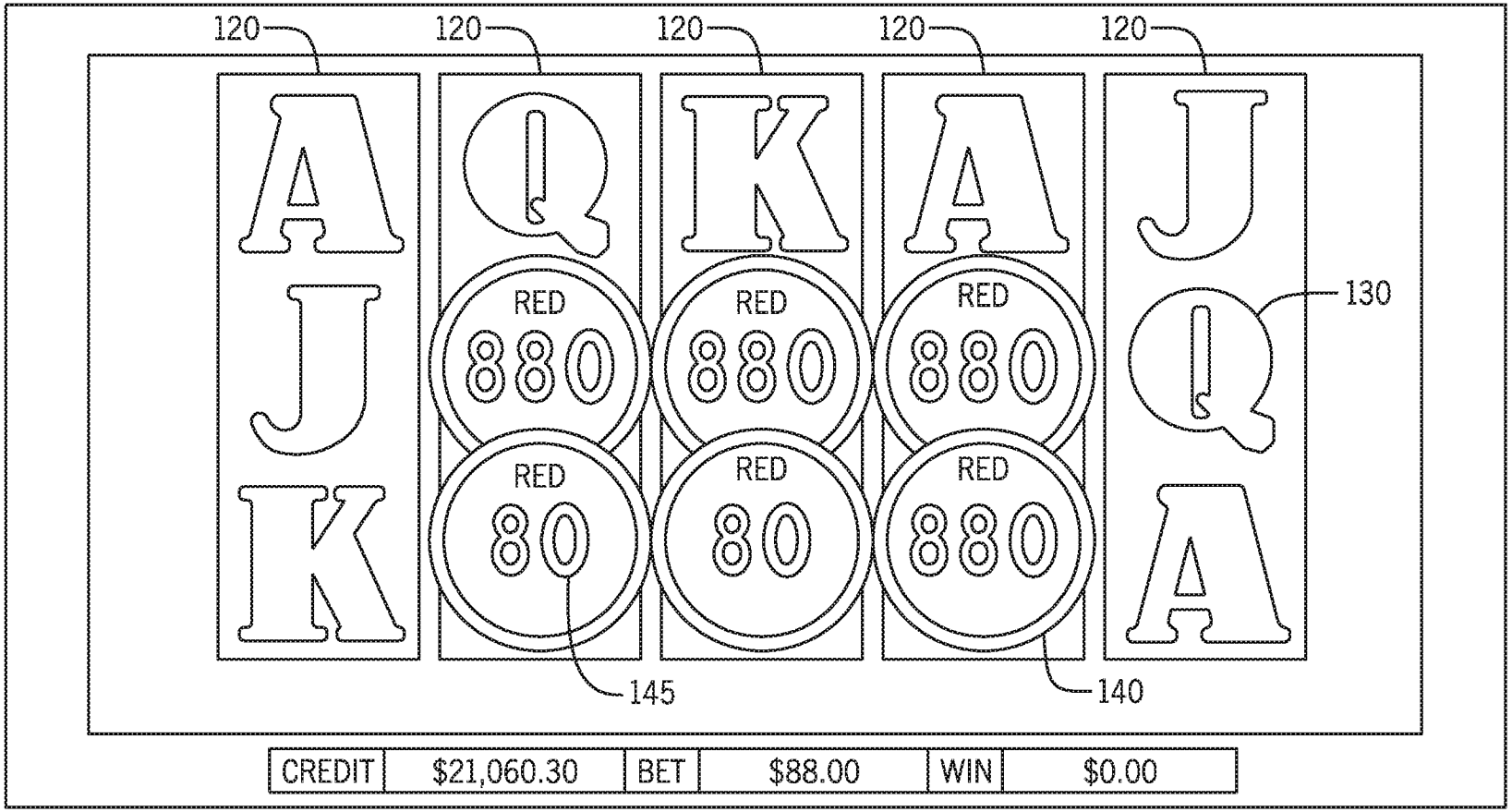
FIG. 1 is an image of an exemplary base-game screen of a wagering game displayed on a gaming machine, according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

The current invention comprises an innovative application of data processing steps that, when implemented by logic circuitry, direct an electronic display device to present a symbol-value aggregation process that minimizes processing overhead by utilizing numbered indicia to represent credit values instead of complex, fanciful game images. Further, the process aggregates displayed values on special symbols according to stored, variable criteria. In this way, the special symbols provide building blocks for innumerable different aggregation sequences simply by manipulating the aggregation criteria associated with the special symbols, resulting in fewer rules needed for the aggregation process than would be necessary for calculating values of winning symbol combinations enumerated in stored paytables, as found in prior art reel-spinning routines.

At the same time, the invention provides a straightforward, what-you-see-is-what-you-get (WYSIWYG) visual presentation that is simple to understand and, therefore, effective in generating player excitement and enthusiasm.

The result is a highly flexible value-aggregation process that can be easily adapted to any theme/brand while remaining easily understood by players.

The inventive value-aggregation process may be utilized in a base game or a bonus game. In one illustrated embodiment, the process is triggered by an event in a base game which initiates a bonus feature in which the differentiated aggregation mechanism is implemented. While this specification has been written to detail illustrative embodiments of the invention, it should be noted that variations and adaptations for implementing the inventive process in different base and bonus configurations are possible as a result of the disclosure of the illustrated embodiments below.

Referring now to FIG. 1, there is illustrated an image of a basic-game screen adapted to be displayed on an electronic display device. The basic-game screen portrays a base array 110 of a plurality of simulated symbol-bearing reels 120.

Alternatively or additionally, the base array 110 may portray a plurality of mechanical reels or other video or mechanical presentation consistent with the game format and theme. In FIG. 1, the base array may display game symbols such as symbols 130. In the embodiment of FIG. 1, there is also displayed a plurality of RED coin symbols 140 which may trigger a bonus feature.

In an embodiment of the invention, the value-aggregation feature may be initiated in various ways. In some games, the base array operates according to the value-aggregation procedure at all times—in others, the value-aggregation feature is triggered by a designated event, such as an occurrence of a plurality of special symbols. The triggering may depend on the plurality exceeding a threshold number. Or, the triggering may require the members of the plurality occur in a predetermined pattern in the base array. The value-aggregation feature may be initiated by a mystery trigger, such that the trigger may be invisible to an observer. The triggering may depend on various other criteria and combinations thereof.

In the array shown in FIG. 1, the RED coin symbols each display a number representing the value 145 of the respective RED coin symbol, for example, 80 or 880. Here and throughout, various symbols may be labeled with exemplary descriptors (e.g., RED, GREEN, GOLD, etc.). These descriptors are provided for easy reference and are not intended to designate specific features or to limit the distinctive aspects of any symbols. Triggering symbols and/or other value-bearing symbols may be represented as coins, numerals, or any other distinguishable game imagery. In an embodiment, an occurrence of the designated trigger event (e.g., a threshold number of RED coin symbols) may cause the base game to transition to a bonus feature or bonus game. In this embodiment, the RED coin symbol values provide "seed" or initial values that will be utilized during the value-aggregation feature. Alternatively, or additionally, other methods and means for providing seed values may be utilized, and these various alternative approaches are considered to be within the general aspect and spirit of the current invention.

Figure 2:
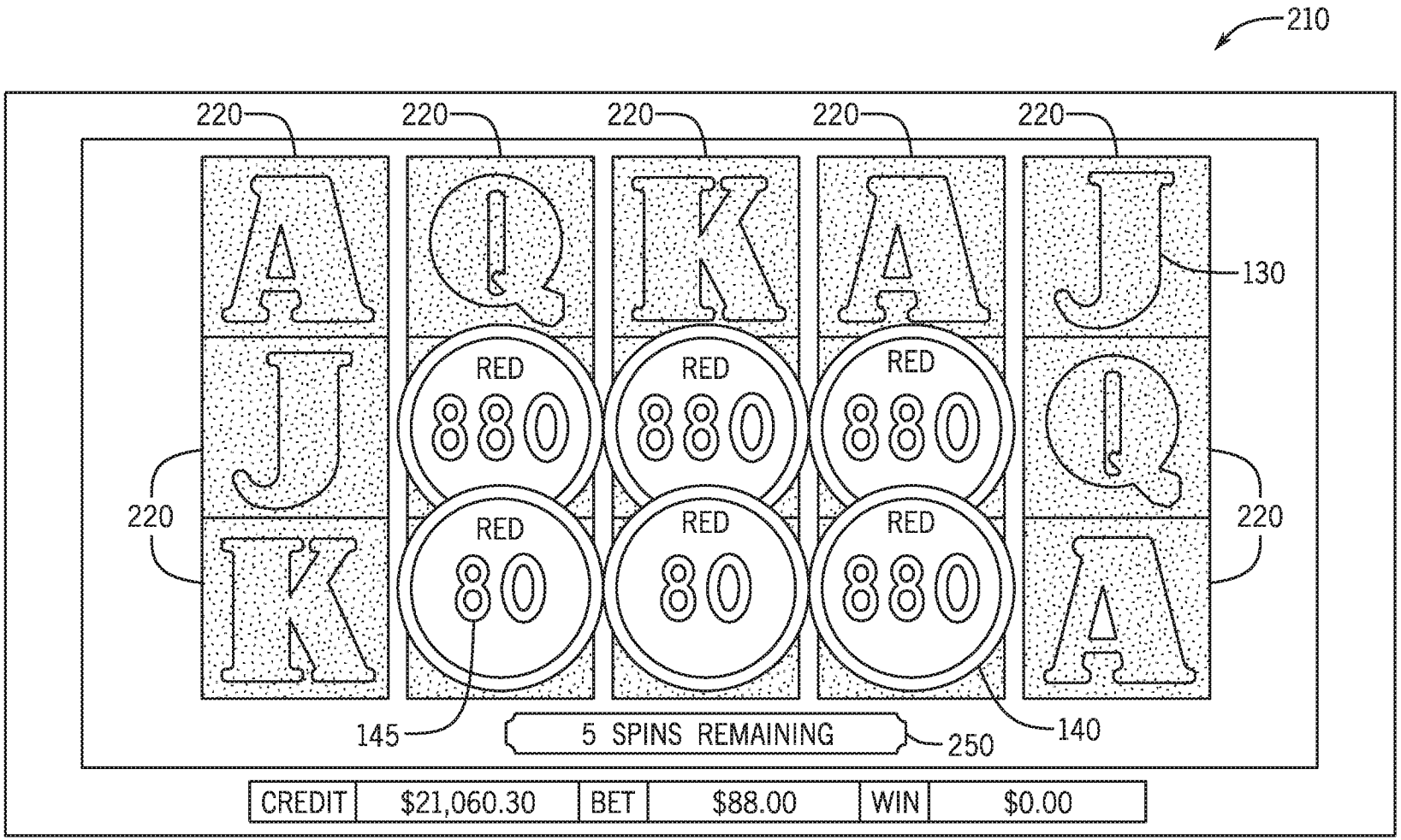
FIG. 2 is an image of an exemplary bonus-game screen of a wagering game displayed on a gaming machine, according to an embodiment of the present invention.

In FIG. 2 there is shown a bonus array 210 that that is displayed in response to the trigger event shown in FIG. 1. In an embodiment, the bonus array 210 comprises a plurality of independent symbol-bearing reels 220. Independent symbol-bearing reels, as used here and through, are defined as reels that display a single symbol in a single position in an array, as contrasted with some conventional reels which may occupy an entire column of an array with the symbols being displayed in fixed relation to each other (as along a reel strip). The independent symbol-bearing reels may include reel strips also, but they only display a single symbol at a time. The independent symbol-bearing reels include special symbols (such as assorted coin symbols) that are acted upon according to specific aggregating criteria in accordance with an embodiment of the invention.

In the bonus array 210, the plurality of RED coin symbols 140 that originally triggered the bonus feature appear in a subset of the symbol positions of the bonus array 210. In an embodiment, the plurality of RED coin symbols 140 are displayed in the same array positions as they appeared in the base array. In another embodiment, a triggering plurality of symbols may be redistributed or even replaced by different numbered symbols or indicia. Also, the bonus array 210 is the same size (i.e., 3×5) as the base array 110, but it is envisioned that a bonus array may have a different configuration than a base array, for example, a bonus array may expand or contract either vertically or horizontally (i.e., have different number of columns and/or rows). In bonus array 210, the symbol positions that are not occupied by RED coin symbols are grayed out (partially obscured) and, in an embodiment, may be blank. Since these symbols are largely irrelevant during the feature—only the special feature symbols are evaluated for value aggregation, at least in one embodiment—the reel strips of the unoccupied reels may be extremely simple (or blank). Also, a free-spin meter 250 is shown below the bonus array 210 and indicates that a predetermined number of spins have been allotted for this feature. In an embodiment, the predetermined number may be fixed or randomly determined. In an embodiment, the triggering plurality of symbols (e.g., the RED coin symbols) are held throughout the bonus feature spins.

Figure 3:
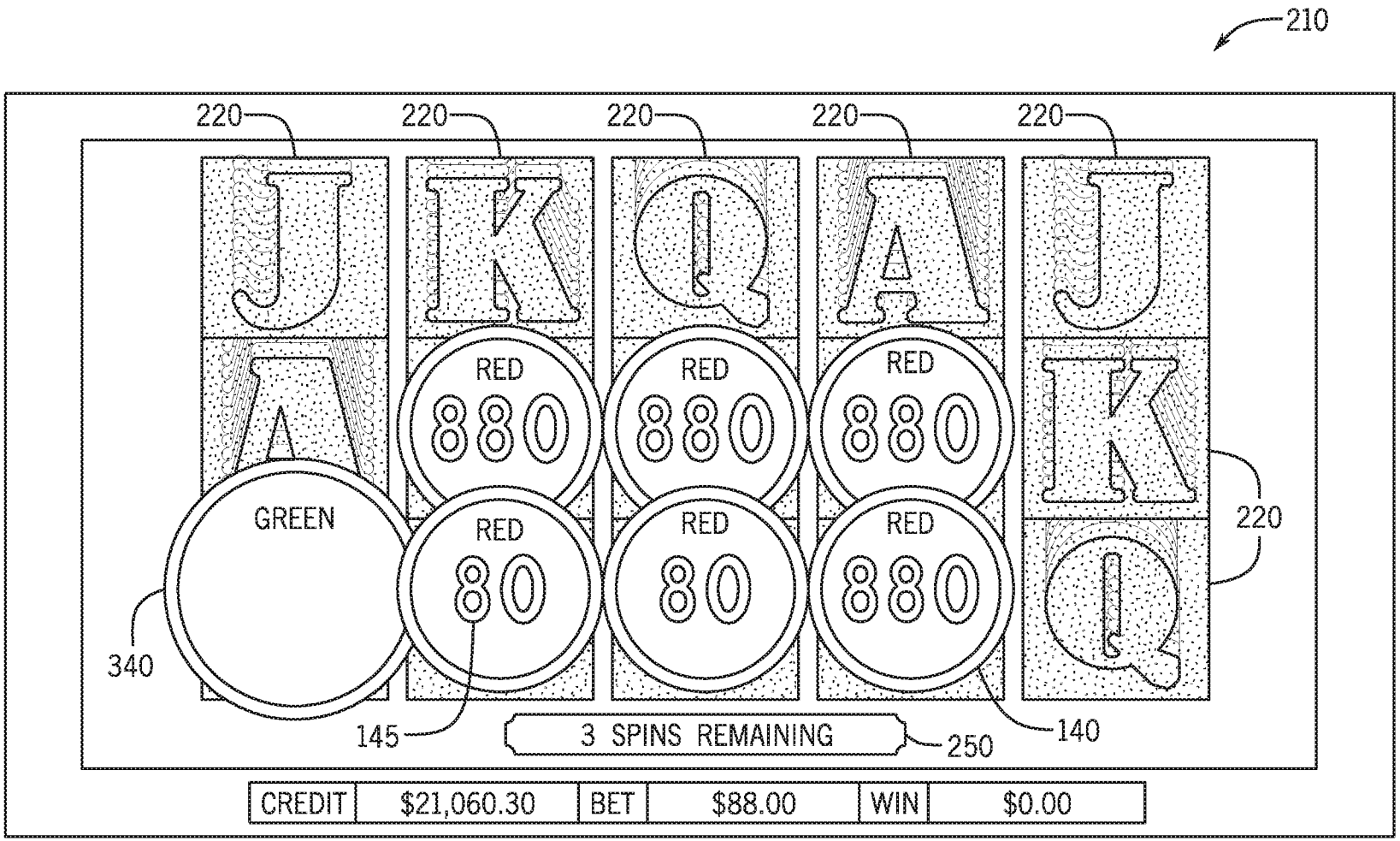
FIG. 3 is an image of the array shown in FIG. 2, during a subsequent spin.

Referring now to FIG. 3, the array 210 is shown mid-spin during the third spin, after the first two spins have completed uneventfully. The plurality of RED coin symbols 140 are held in their positions in the array 210. A GREEN coin symbol 340 has landed in one of the unoccupied (by a RED coin symbol) symbol positions. In this embodiment, GREEN coin symbols are special aggregating symbols that receive aggregate values according to specific criteria. Since the third spin has not yet completed (meaning some of the independent symbol-bearing reels are still spinning), no value has been allotted to the GREEN coin symbol 340.

Figure 4:
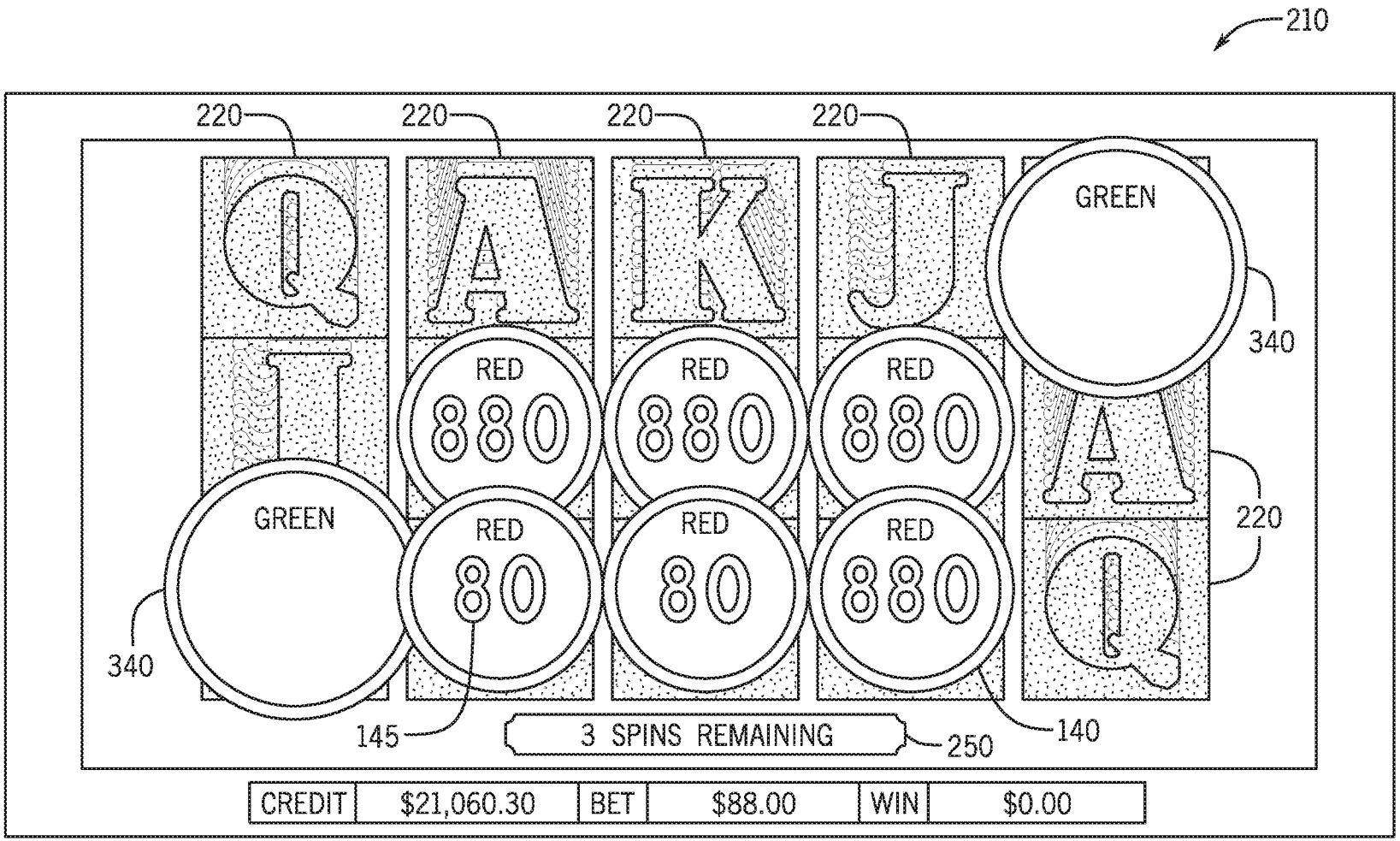
FIG. 4 is another image of the array shown in FIG. 3.

Referring to FIG. 4, some reels are still spinning during the third spin, and another Green coin symbol 340 has landed in the bonus array. Again, since the third spin is ongoing, no values have been allotted to either GREEN coin symbol 340.

Figure 5:
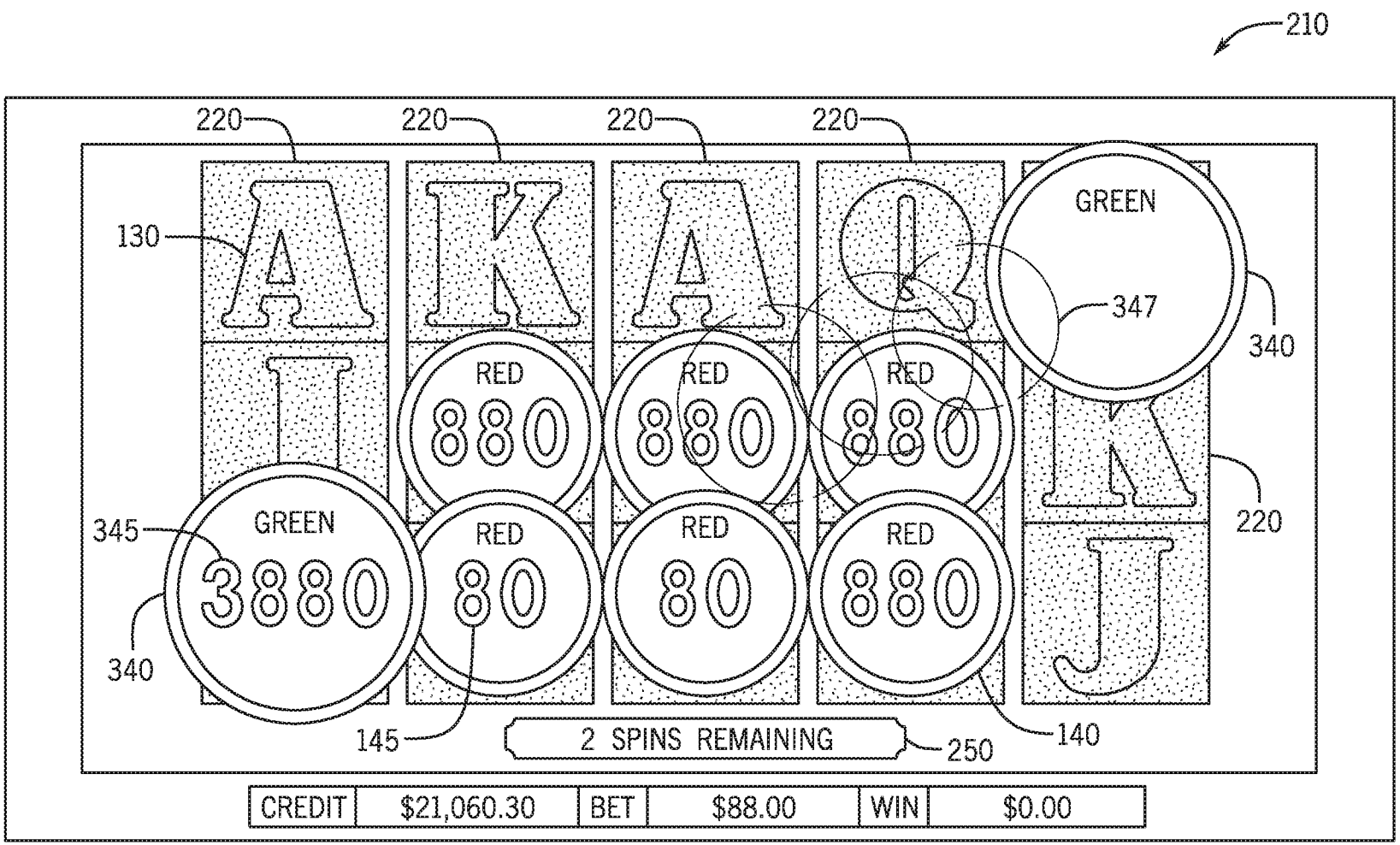
FIG. 5 is an image of the array shown in FIG. 4, during value aggregation.

As shown in FIG. 5, the third spin is complete and the reels are stopped. After the spin, aggregate values for the GREEN coin symbols 340 are tallied according to the criteria corresponding to GREEN coin symbols. In this embodiment, the criteria for GREEN coin symbols requires each GREEN coin symbol to receive the sum of values of all the value-bearing symbols displayed at the time the GREEN coin symbol lands in the array. The first GREEN coin symbol has received the aggregate value 345 of all currently displayed symbols, which (for the first GREEN coin symbol) comprise the plurality of RED coin symbols 140. The second GREEN coin symbol 340 will also receive the aggregate value 345 of all currently displayed symbols, which will include the plurality of RED coin symbols 140 PLUS the first GREEN coin symbol 340, which landed before the second GREEN coin symbol. Aggregation of the values for the second GREEN coin symbol is indicated by the phantom circles 347 traveling to the second GREEN coin symbol.

Figure 6:
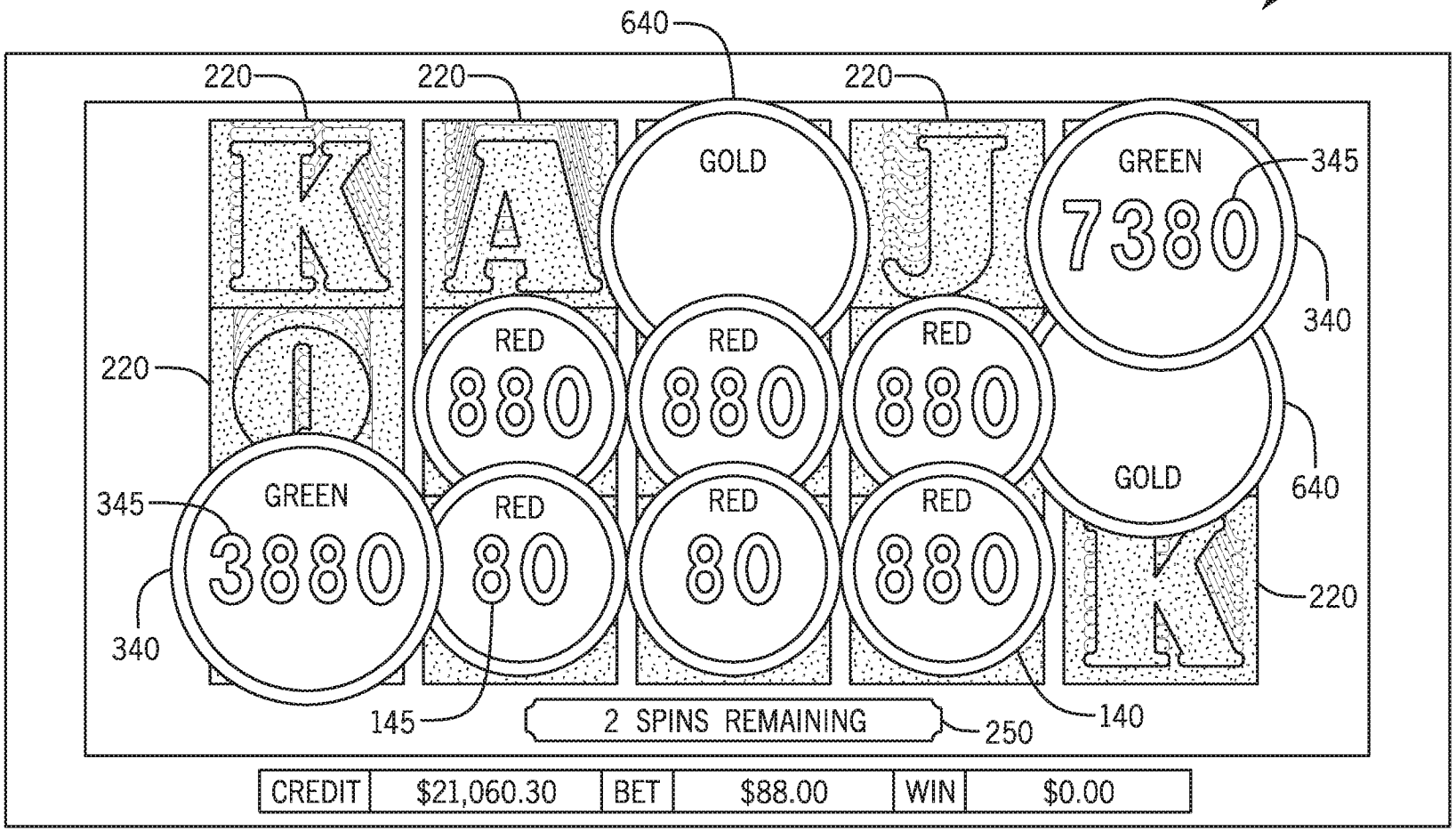
FIG. 6 is an image of the array shown in FIG. 5, during a subsequent spin.

Referring to FIG. 6, the array 210 is shown mid-spin during the fourth spin. Two GOLD coin symbols 640 have landed in symbol positions of the array 210. According to an embodiment, GOLD coin symbols are also special aggregating symbols and will receive values according to criteria corresponding to GOLD coin symbols. As shown in FIG. 6, the GOLD coin symbols 640 have not yet been allotted aggregate values. Symbols are still spinning in the remaining symbol positions of the array 210.

Figure 7:
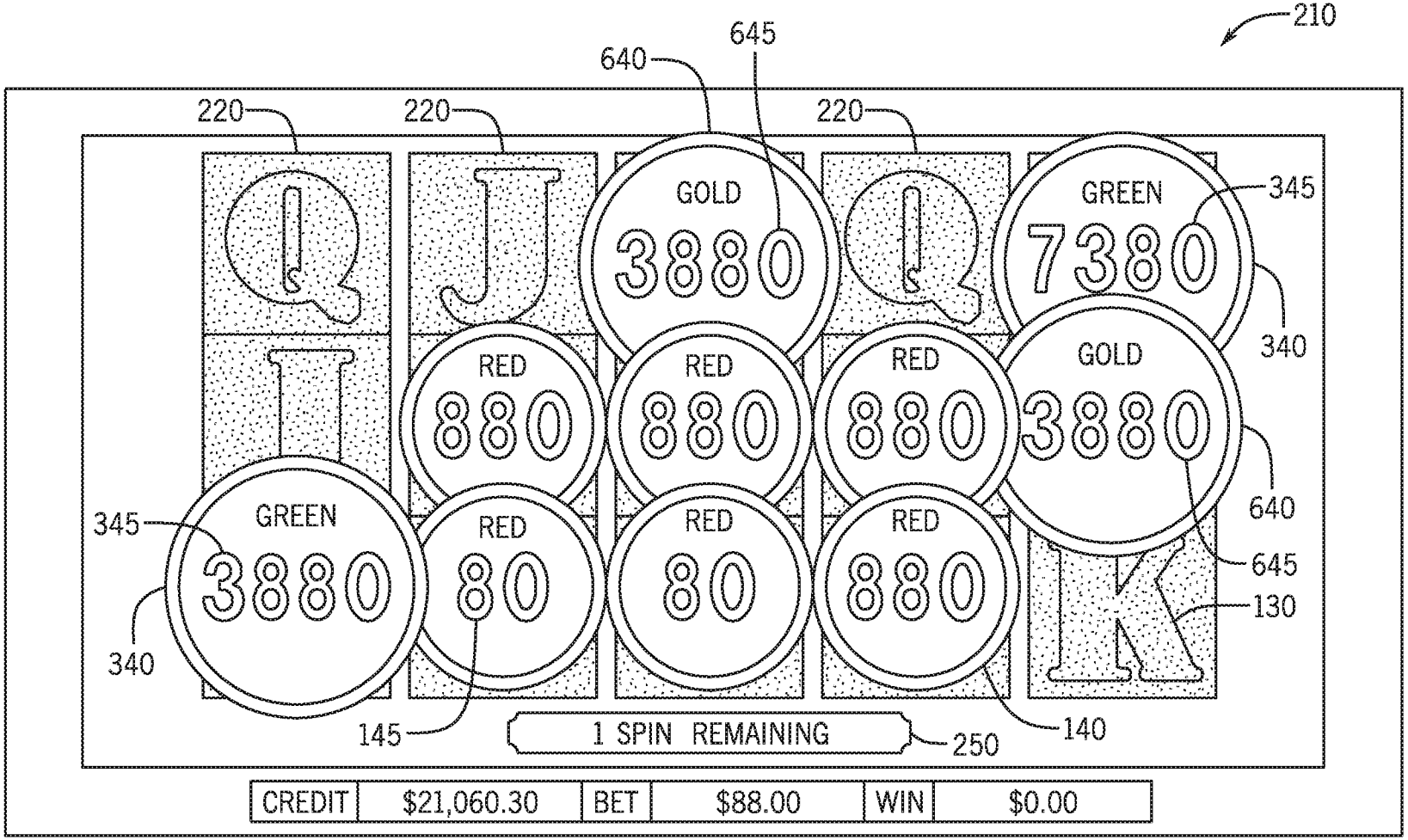
FIG. 7 is an image of the array shown in FIG. 5, after completing the spin and value aggregation.

As shown in FIG. 7, the fourth spin has completed and aggregate values 645 have been allotted to the two GOLD coin symbols 640. According to the value-aggregation criteria for GOLD coin symbols, each GOLD coin symbol receives the sum of values of the plurality of RED coin symbols (i.e., 3880).

Additionally or alternatively, special symbols may be updated with new values during or after being held in the array. In an embodiment, an updating event may occur an cause one or more displayed values to increase according to specific criteria. The values may change by adding an new value to the displayed value, but applying a multiplier, and by various other means and combinations thereof.

Figure 8:
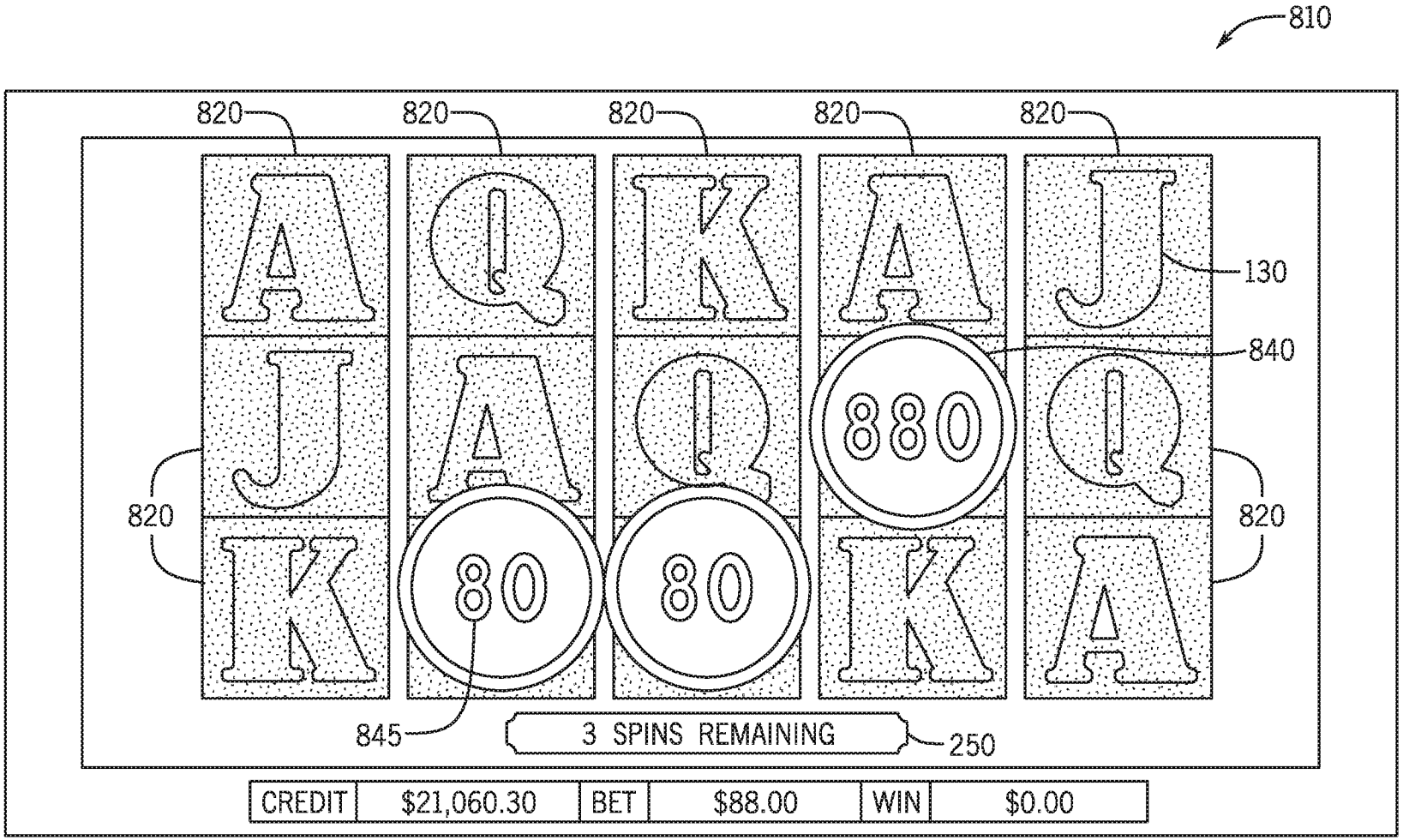
FIG. 8 is an image of an exemplary game screen of a wagering game displayed on an electronic display device, according to another embodiment of the present invention.

In another embodiment, illustrated in FIG. 8, special symbols receive aggregate values in response to position-based criteria. For example, in the array 810, three coin symbols 840 have landed after a spin of the individual symbol-bearing reels 820. The coin symbols 840 display respective values 845. As in the previously discussed embodiment, grayed-out AKQJ10 130 symbols spin in the symbol positions but are not evaluated during the value-aggregation process.

Figure 9:
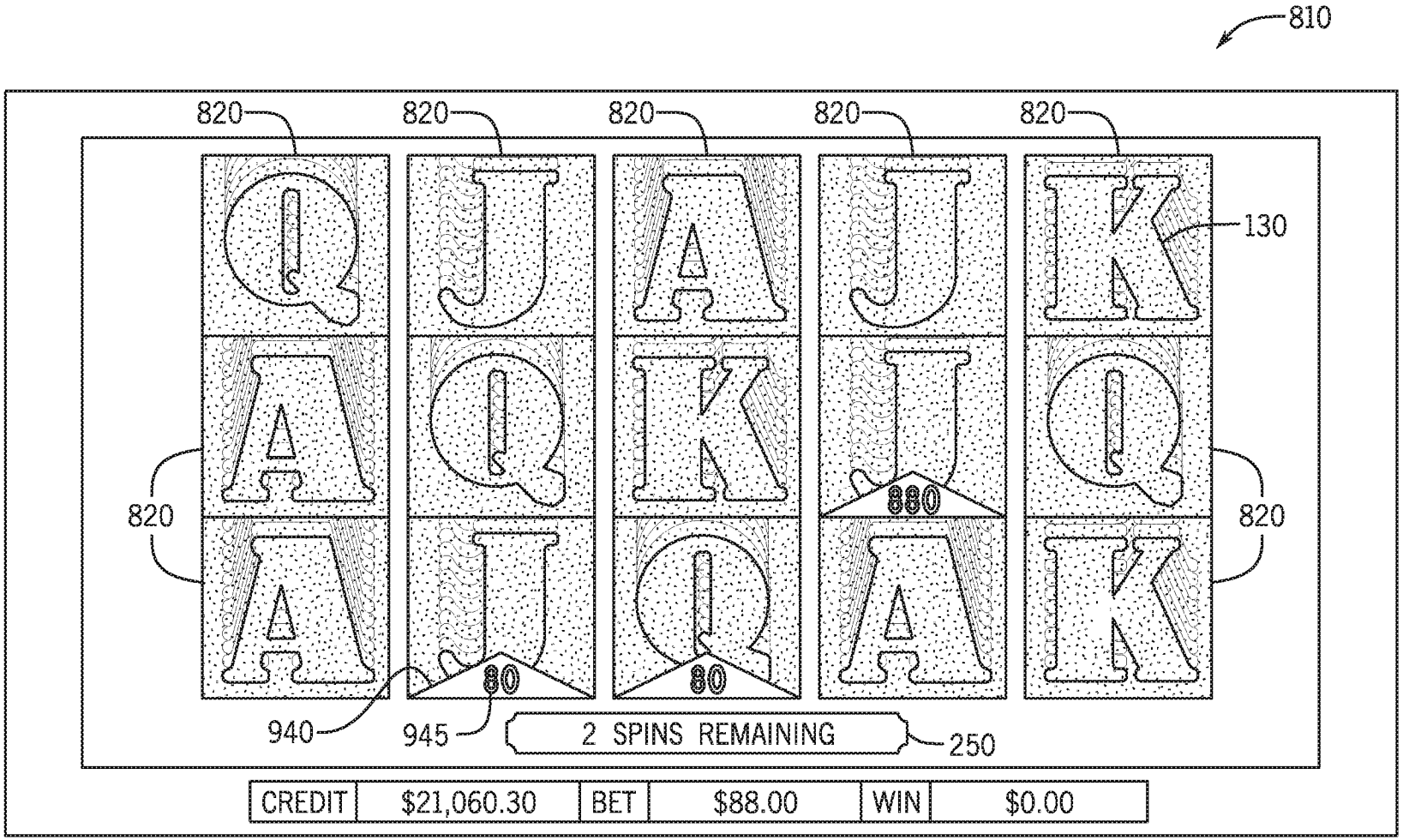
FIG. 9 is an image of the array shown in FIG. 8, during a subsequent spin.

FIG. 9 shows the array 810 during the next subsequent spin. This embodiment holds the symbols in the array by attaching a value-indicia watermark to the respective symbol positions where the special symbols occur. As shown in FIG. 9, the embodiment displays the watermarks (e.g., the triangular chevrons 940) in the respective symbol positions, each chevron 940 displaying the value 945 of the establishing coin symbol. Behind the chevrons 940, the individual symbol-bearing reels spin and stop to provide more opportunities for value-aggregation.

Figure 10:
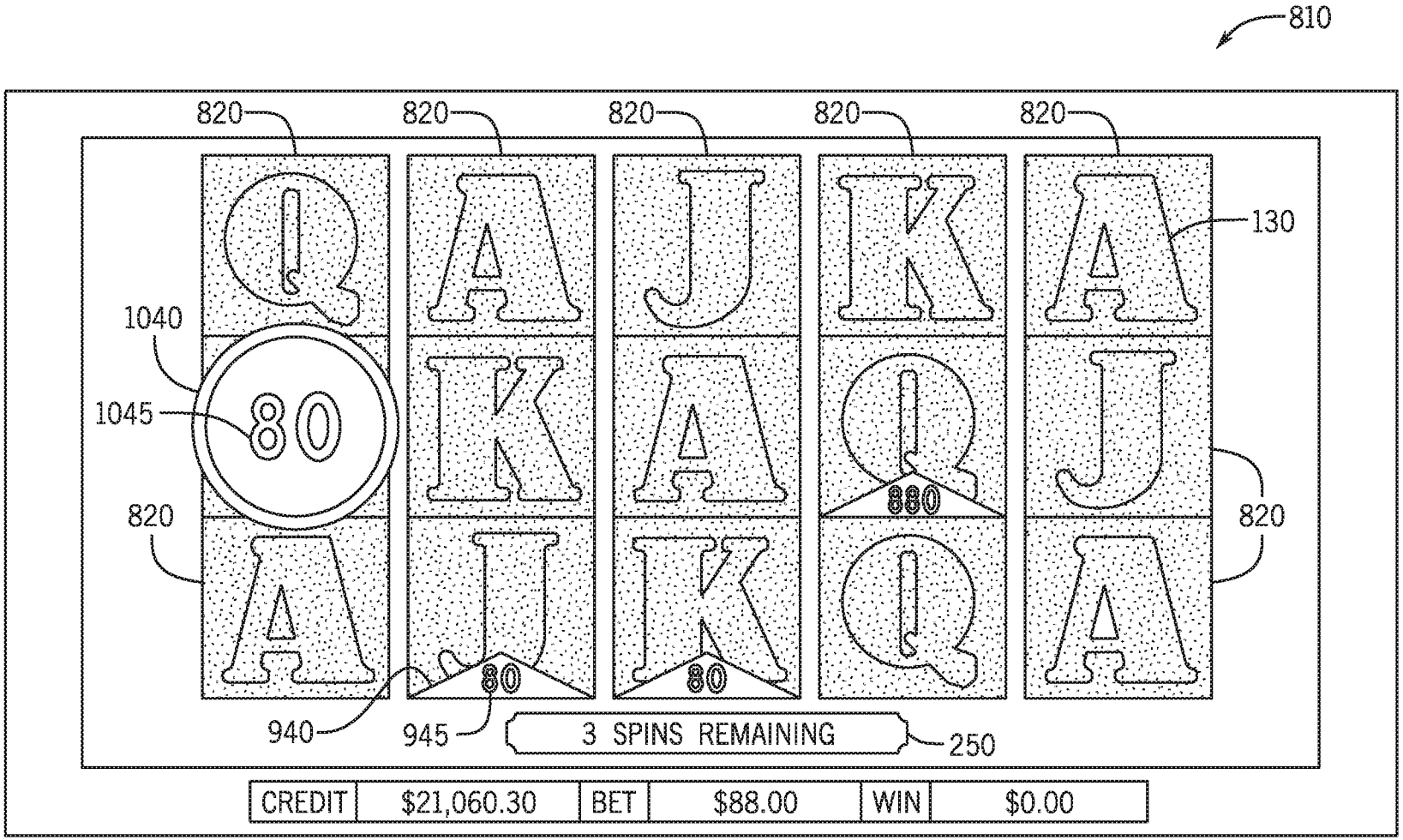
FIG. 10 is an image of the array shown in FIG. 9, after the subsequent spin.

Referring to FIG. 10, the spin has resulted in a new coin symbol 1040 landing in a symbol position that is not displaying a chevron from a previous coin symbol. A new coin symbol in an unoccupied symbol position not only contributes its displayed value (added to a new chevron) but may provide other benefits according to criteria implemented in an embodiment. For example, the new coin symbol 1040 may cause the free-spin meter 250 to reset to a predetermined number (i.e., 3 remaining spins).

Figure 11:
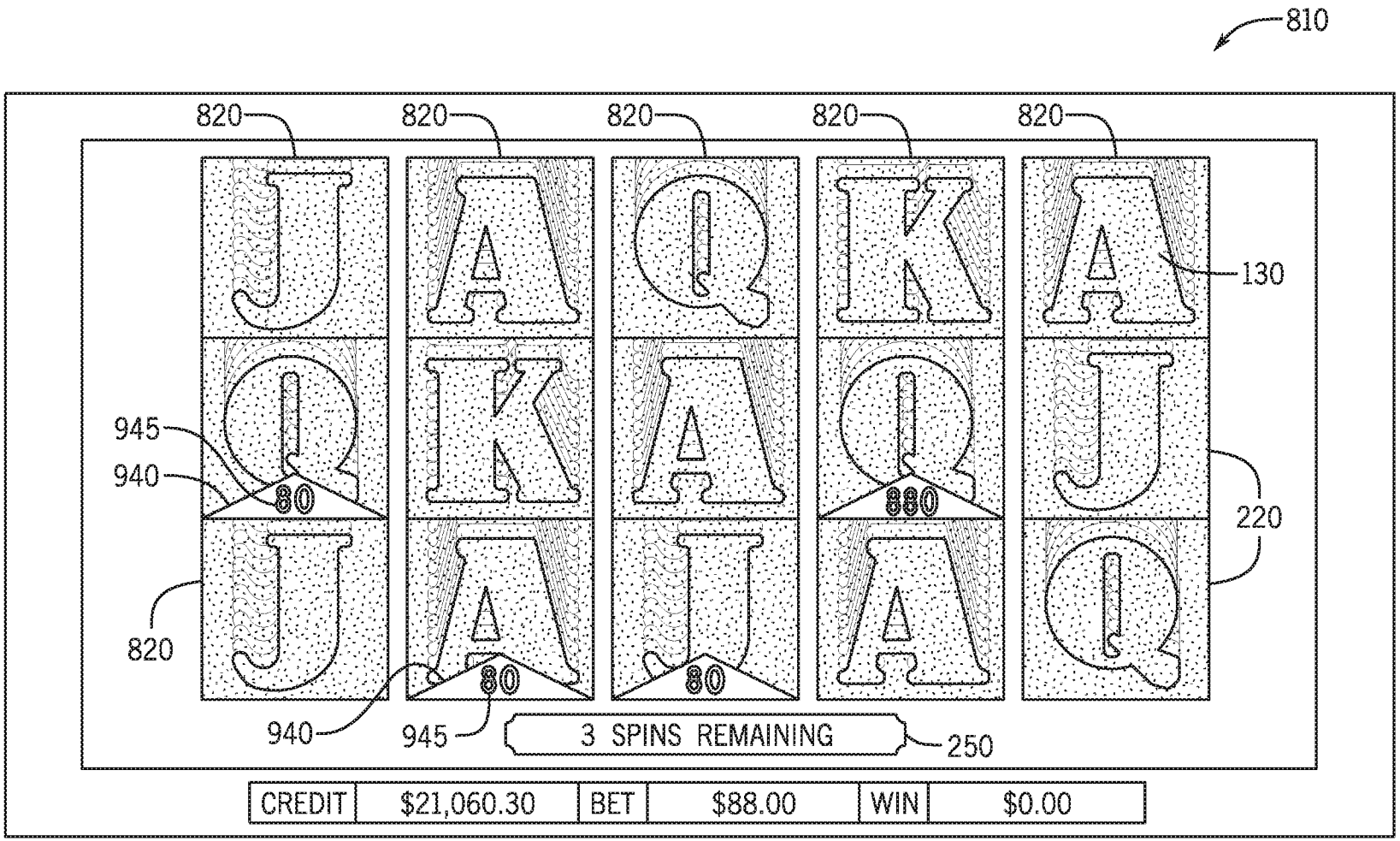
FIG. 11 is an image of the array shown in FIG. 10, during another subsequent spin.

In FIG. 11, another spin has begun, and the new chevron 940 including the value 945 of the establishing coin symbol is visible with the spinning reel symbols behind the chevron 940.

Figure 12:
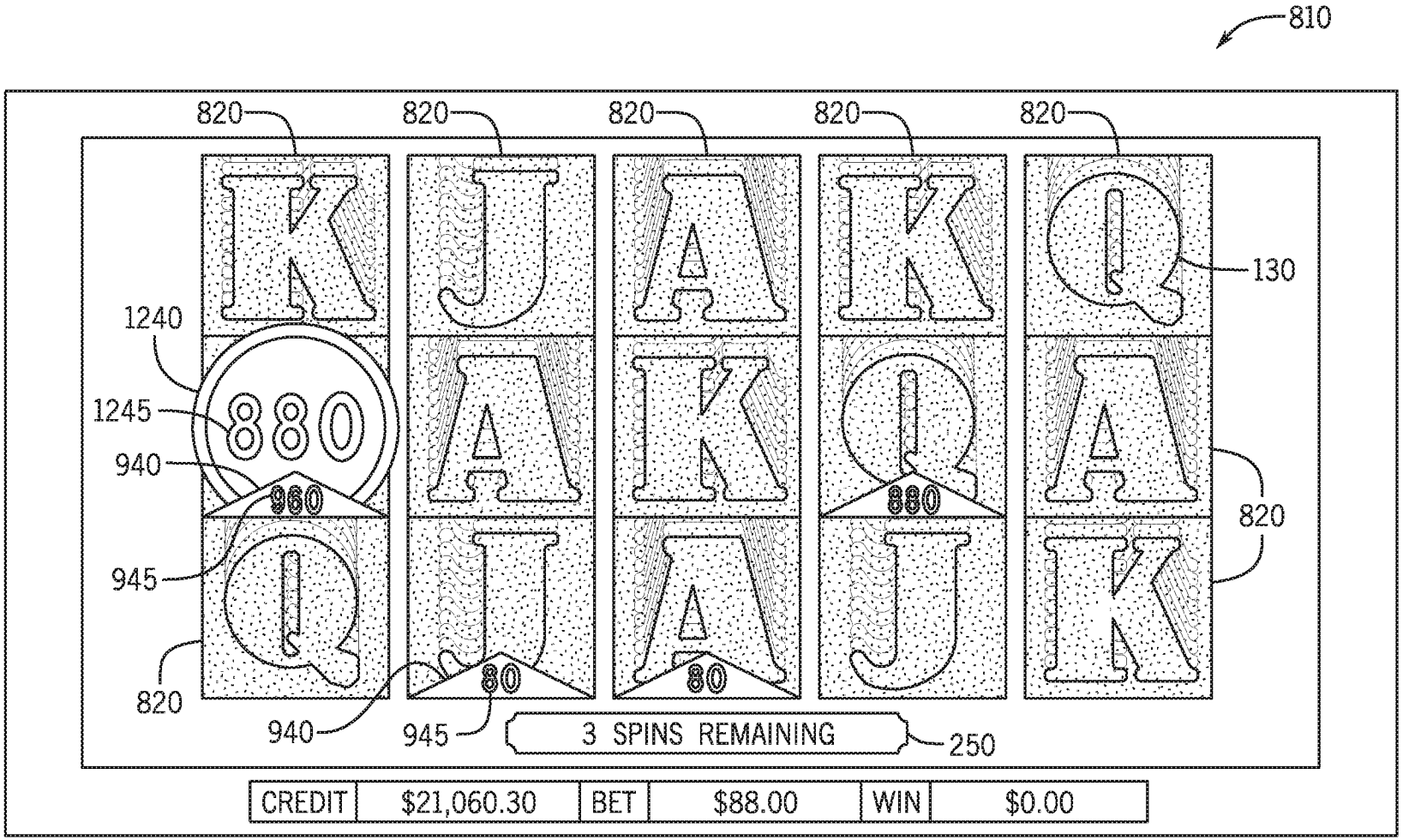
FIG. 12 is an image of the array shown in FIG. 11, during the subsequent spin.

Referring now to FIG. 12, another new coin symbol 1240 has landed in a symbol position that already contains a chevron 940 from a previous coin symbol. The value 1245 of the new coin symbol 1240 is added to the previous value of the chevron 940 to display a new aggregate value 945.

The embodiment illustrated in FIGS. 8-12 can be triggered from a base game or initiated as a base game itself. For example, the array 810 may be triggered from a base game array in which a threshold number of coin symbols occur. The triggering coin symbols may then be held over in positions in the array 810, which could be considered a bonus feature array.

As illustrated in FIGS. 1-12 and in the remarks above, embodiments of the current invention provide an innovative procedure for aggregating values of symbols in an array. Logic circuitry executing instructions in accordance with the invention present a visual display of spinning reels with clearly enumerated symbology that combine in readily understood arrangements to increase in value. An observer experiences excitement and anticipation as new symbols land in the array and aggregate values are summed and displayed. In stark contrast to conventional reel-spinning games in which symbol images are evaluated for winning combinations by paytable rules, the current invention provides immediately recognizable values in its WYSIWYG display configuration while adding secondary—and in some embodiments, a tertiary—layer of variability for the creation of values of certain symbols.

The value-aggregation procedure may be symbol- and game-agnostic. Themes and imagery of symbols and environment may be varied with no effect on the value-aggregation process. Or, if so desired, the criteria for value-aggregation may be modified in innumerable ways to produce new visual effects and exciting summation sequences.

Further benefits are realized in increased computer processing efficiency, fewer rules to be evaluated, and simpler graphical representations. For example, in a conventional paytable evaluation, overlapping payline sections require multiple evaluation steps. Often, analysis is required to determine which payline results in the highest credit total, with the lesser value paylines being discarded but only after being evaluated—all this adds to processing overhead. Special symbols like WILDS, multipliers and scatter symbols can modify paytable values and may require separate, additional evaluation according to customized rule sets. All these procedures can be inherently more complex than simple aggregation (i.e., addition) of number values. The invention represents a win-win: simpler, almost self-explanatory graphics combined with faster, more efficient processing. The inventive value-aggregation procedure can be implemented on the vast majority of casino gaming machines without requiring upgrades or modifications.

Figure 13:
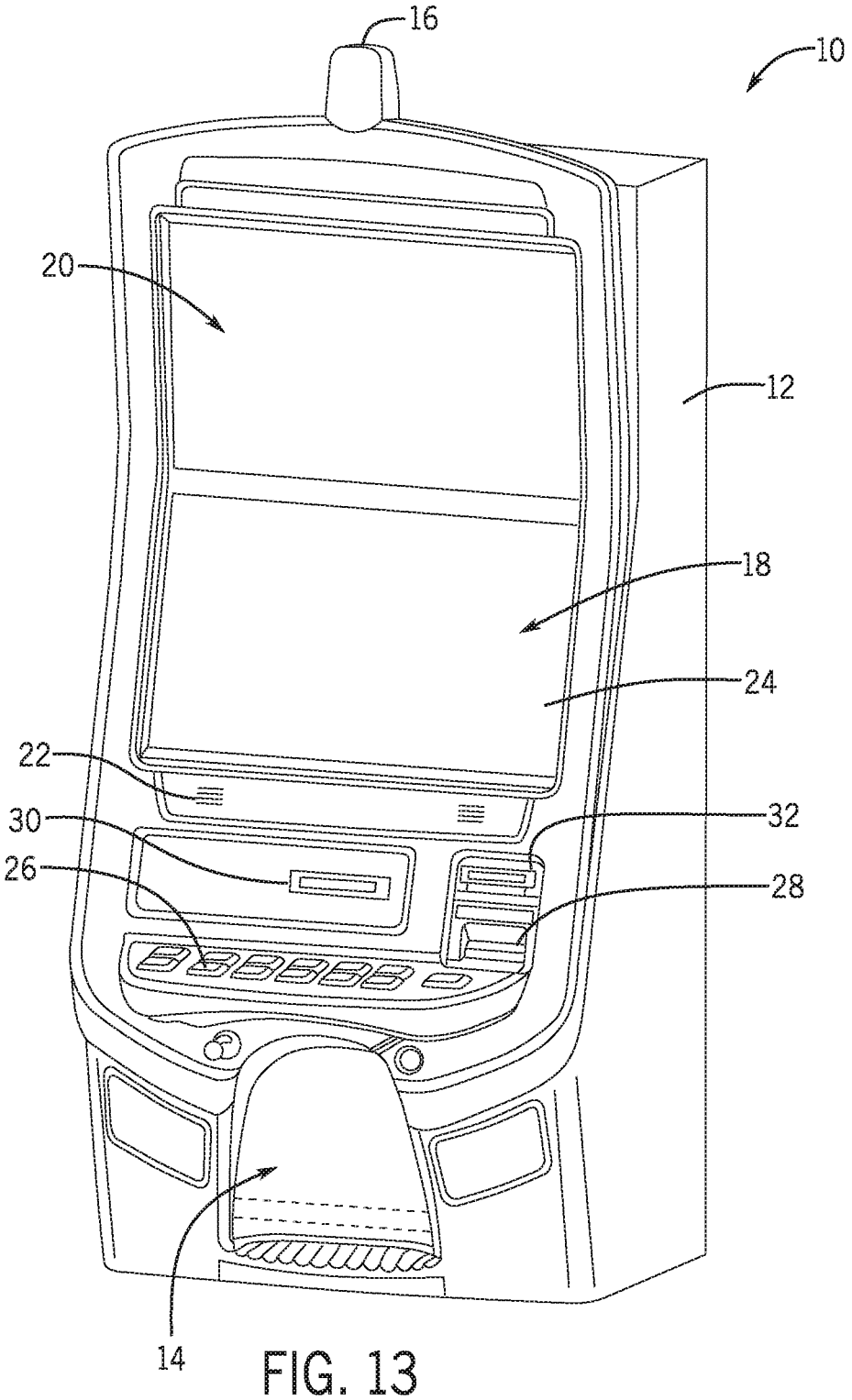
FIG. 13 is a perspective view of a free-standing gaming machine according to an embodiment of the present invention.

Referring to FIG. 13, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 13 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 15). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 15), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 14:
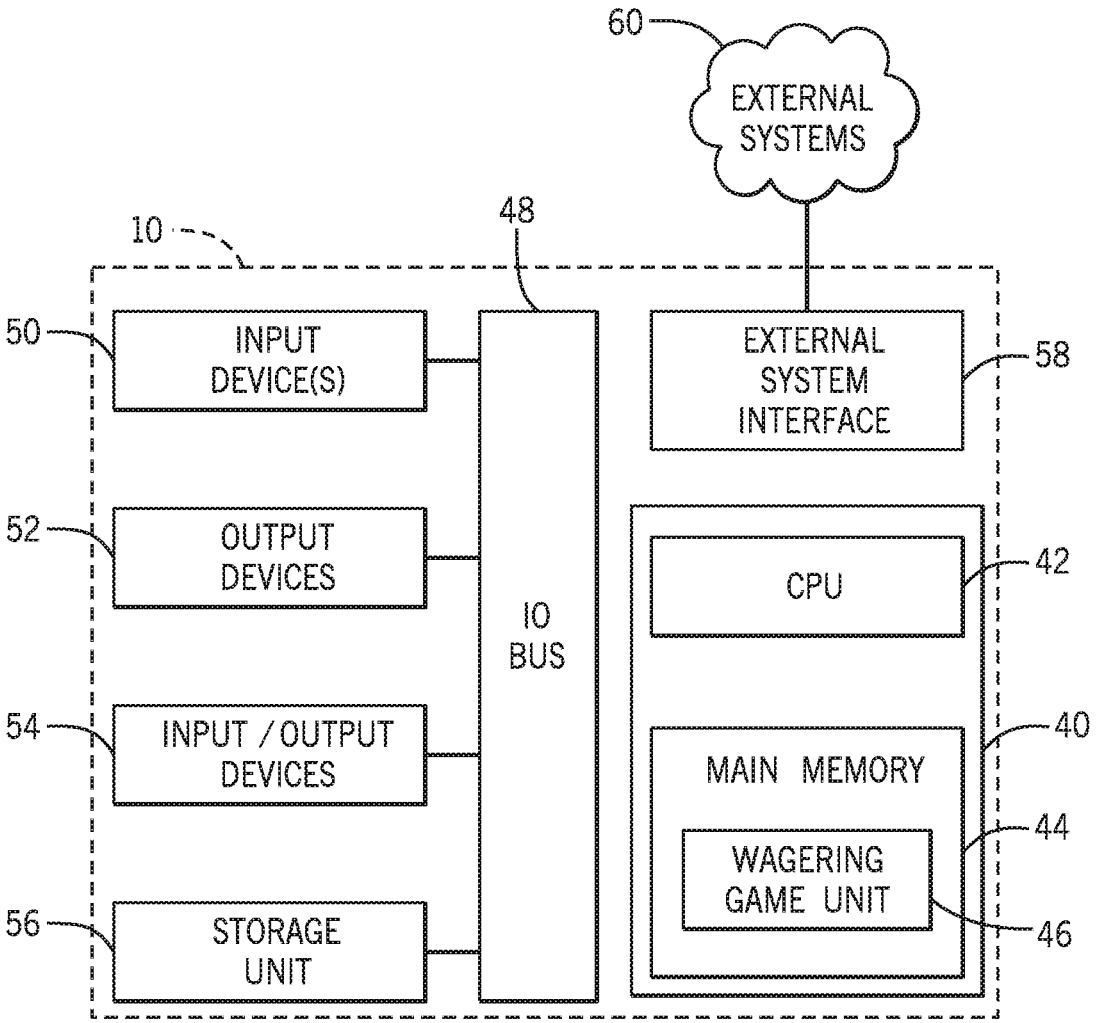
FIG. 14 is a schematic view of a gaming system according to an embodiment of the present invention.

Turning now to FIG. 14, there is shown a block diagram of the gaming-machine architecture. The gaming machine 10 includes game-logic circuitry 40 securely housed within a locked box inside the gaming cabinet 12 (see FIG. 13). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video blackjack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 13. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 14. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 15:
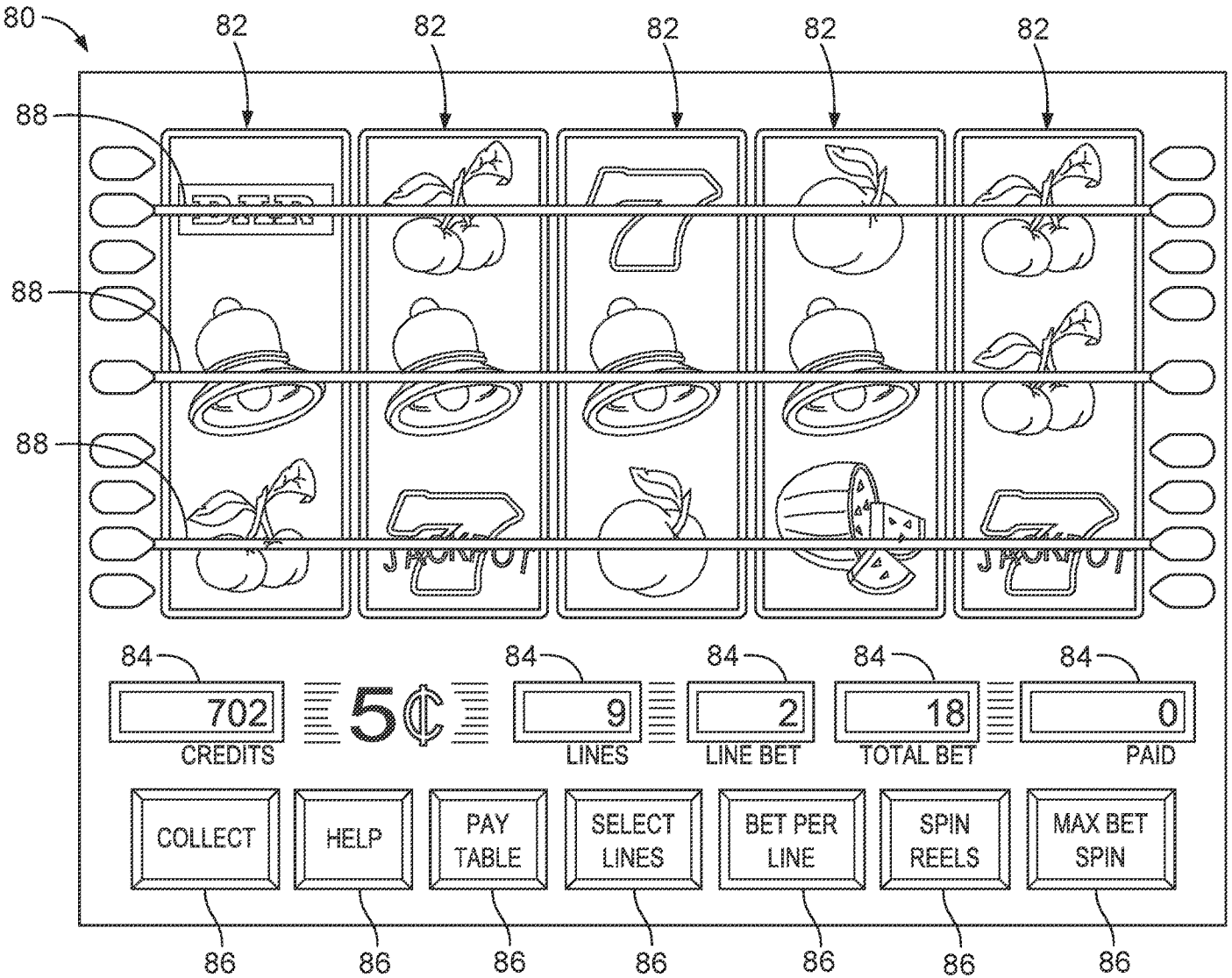
FIG. 15 is an image of an exemplary basic-game screen of a wagering game displayed on a gaming machine, according to an embodiment of the present invention.

Referring now to FIG. 15, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 13. The game-logic circuitry 40 operates to execute a wagering-game program causing the primary display 18 or the secondary display 20 to display the wagering game.

In response to receiving an input indicative of a wager covered by or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 13, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 16:
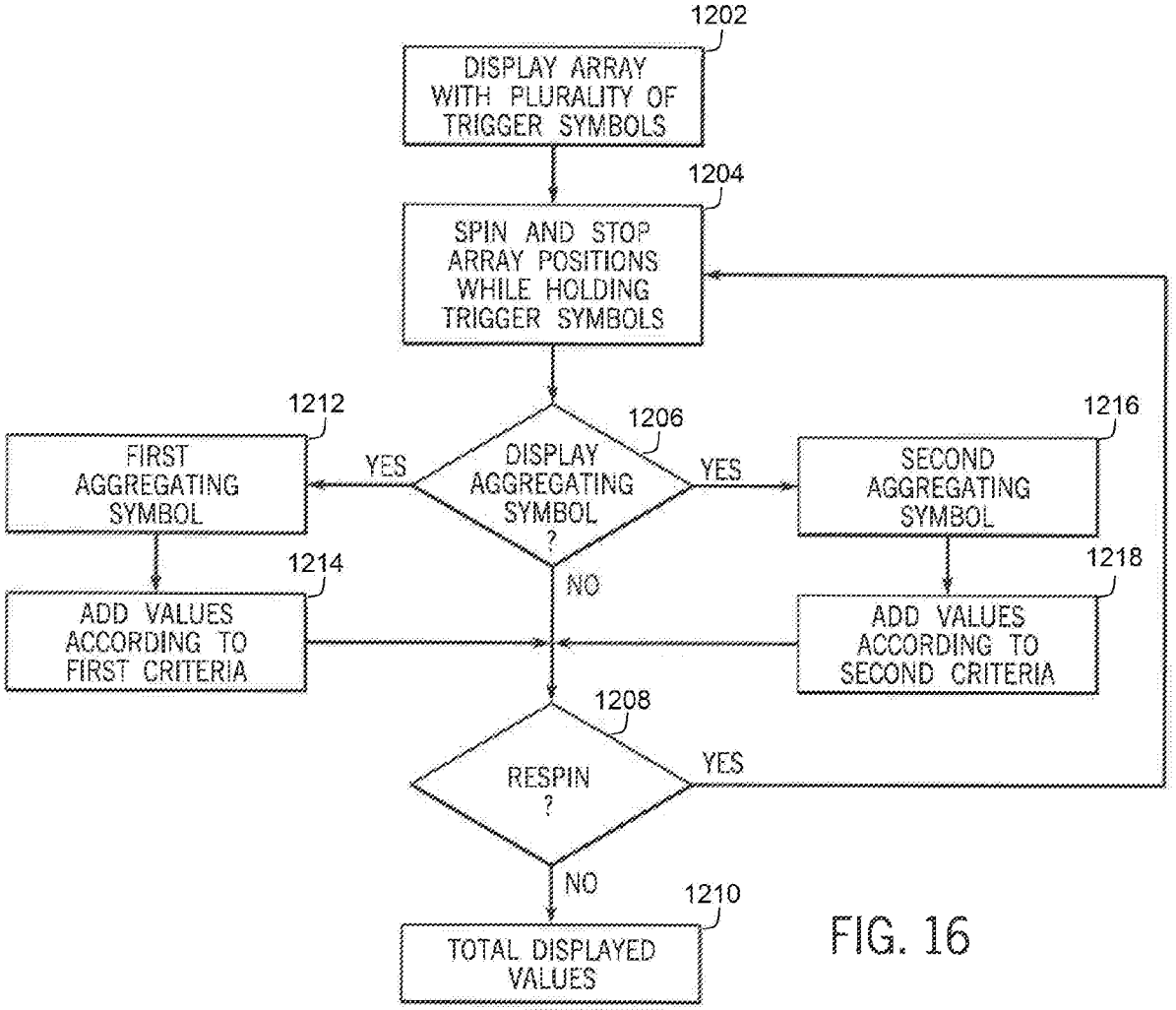
FIG. 16 is a flowchart for a data processing method that corresponds to instructions executed by logic circuitry in accord with at least some aspects of the disclosed concepts.

FIG. 16, described by way of example above, represents one data processing method that corresponds to at least some instructions stored and executed by the game-logic circuitry 40 in FIG. 14 to perform the above described functions associated with the disclosed concepts.

In FIG. 16, the method includes displaying 1202 an array that includes a plurality of trigger symbols. The symbols in the array spin and stop 1204 while the plurality of trigger symbols are held in place in the array. The method evaluates 1206 whether an aggregating symbol is displayed in the array after stopping the spinning symbols.

If there are no aggregating symbols displayed in the array, the method proceeds to determine 1208 whether there are any remaining spins. If there are remaining spins, the method returns to step 1204 for respinning. If there are no remaining spins, the method proceeds to determine 1210 a total displayed value by summing the values of the displayed symbols.

In response to a determination 1212 at step 1206 that a first aggregating symbol is displayed in the array, the method adds 1214 values to the first aggregating symbol according to first criteria. After adding values to the first aggregating symbol, the method proceeds to step 1208.

In response to a determination 1216 at step 1206 that a second aggregating symbol is displayed in the array, the method adds 1218 values to the second aggregating symbol according to second criteria. After adding values to the second aggregating symbol, the method proceeds to step 1208

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system with differential symbol-value aggregation features, the gaming system comprising:

a gaming machine primarily configured to conduct a casino wagering game, the gaming machine including an electronic display device; and logic circuitry configured to:

direct the electronic display device to, display an array of individual symbol positions populated by independent symbol-bearing reels, a subset of the symbol positions containing a plurality of first symbols, hold the plurality of first symbols in the array while spinning at least one of the reels in the remaining symbol positions of the array, and stop the at least one spinning reel to display one or more additional symbols in the array;

in response to the one or more additional symbols including a first aggregating symbol, add a sum of values of a first set of currently displayed symbols to the first aggregating symbol, wherein the first set of the currently displayed symbols is determined according to first criteria; and in response to the one or more additional symbols including a second aggregating symbol, add a sum of values of a second set of the currently displayed symbols to the second aggregating symbol, wherein the second set of the currently displayed symbols is determined according to second criteria, the first criteria being different than the second criteria, wherein the electronic display device is further directed to: (i) present a value-indicia watermark indicating a respective value for each symbol of both the first set of currently display symbols and the second of currently display symbols and (ii) present an aggregated value-indicia watermark for each of the first aggregating symbol and the second aggregating symbol that indicates a respective aggregate value at least partially as a function of the respective sum of values, the first aggregating symbol being visually distinguishable from the second aggregating symbol.

2. The gaming system of claim 1, wherein the first criteria defines the first set as the plurality of first symbols.

3. The gaming system of claim 1, wherein the second criteria defines the second set as the currently displayed symbols.

4. The gaming system of claim 1, wherein a value of a first symbol is displayed on the first symbol, and wherein a sum of values is displayed on the first and second aggregate symbols.

5. The gaming system of claim 1, wherein the logic circuitry is configured to, in response to the one or more additional symbols including a third aggregating symbol, add a sum of values of a third set of the currently displayed symbols, wherein the third set includes the first and second sets.

6. The gaming system of claim 1, wherein the logic circuitry is configured to, in response to the one or more additional symbols including a third aggregating symbol, add a multiple of a sum of values of one of the first set, second set, or both the first and second sets, to the third aggregating symbol.

7. A method of differential symbol-value aggregation on a gaming machine, the method comprising:

directing, via logic circuitry, an electronic display device to display an array of individual symbol positions populated by independent symbol-bearing reels, a subset of the symbol positions containing a plurality of first symbols;

directing, via the logic circuitry, the electronic display device to hold the plurality of first symbols in the array while spinning at least one of the reels in the remaining symbol positions in the array;

stopping, via the logic circuitry, the at least one spinning reel to display one or more additional symbols in the array;

in response to the one or more additional symbols including a first aggregating symbol, adding, via the logic circuitry, a sum of values of a first set of currently displayed symbols to the first aggregating symbol, wherein the first set of the currently displayed symbols is determined according to first criteria;

in response to the one or more additional symbols including a second aggregating symbol, adding, via the logic circuitry, a sum of values of a second set of the currently displayed symbols to the second aggregating symbol, wherein the second set of the currently displayed symbols is determined according to second criteria, the first criteria being different than the second criteria; and directing, via the logic circuitry, the electronic display device to: (i) present a value-indicia watermark indicating a respective value for each symbol of both the first set of currently display symbols and the second of currently display symbols and (ii) present an aggregated value-indicia watermark for each of the first aggregating symbol and the second aggregating symbol that indicates a respective aggregate value at least partially as a function of the respective sum of values, the first aggregating symbol being visually distinguishable from the second aggregating symbol.

8. The method of claim 7, wherein the plurality of first symbols comprise a plurality of value-bearing symbols, wherein holding the plurality of first symbols in the array comprises holding the value-indicia watermark in each respective symbol position of the subset, the value-indicia watermark corresponding to the value of the first symbol in the respective symbol position, wherein the at least one remaining symbol position includes all symbol positions in the array, wherein the first aggregating symbol comprises a value-bearing symbol displayed in a symbol-position containing the aggregated value-indicia watermark, and wherein the first criteria defines the first set as the sum of the value-indicia watermark and the value of the first aggregating symbol.

9. The method of claim 7, wherein the plurality of first symbols initially occurs in a base game array of symbol-bearing reels, and the occurrence triggers a bonus feature that begins with the display of the array of individual symbol-bearing reels populated by the plurality of first symbols.

10. The method of claim 9, wherein the symbol-bearing reels of the base array include symbols other than first symbols, first aggregate symbols, and second aggregate symbols, and wherein the individual symbol-bearing reels include only first symbols, first aggregate symbols, and second aggregate symbols.

11. The method of claim 7, wherein a first criteria adds the sum of values of the plurality of first symbols to the first aggregating symbol.

12. The method of claim 7, wherein a second criteria adds the sum of values of all the currently displayed symbols to the second aggregating symbol.

13. A gaming system with differential symbol-value aggregation features, the gaming system comprising:

a gaming machine primarily dedicated to playing a casino wagering game, the gaming machine including an input device and an electronic display device; and game-logic circuitry configured to:

detect, via the input device, a physical item associated with a monetary value that establishes a credit balance on the gaming machine;

initiate, responsive to an input indicative of a wager drawn on the credit balance, a base game of the casino wagering game on the gaming machine;

direct the electronic display device to:

display a base array of symbols on symbol-bearing reels, the base array including a plurality of triggering symbols, in response to displaying the plurality of triggering symbols in the base array, display a bonus array of individual symbol positions populated by independent symbol-bearing reels including the plurality of triggering symbols, and hold the plurality of triggering symbols in the bonus array while spinning at least one of the remaining independent symbol-bearing reels, and stop the at least one spinning independent symbol-bearing reel to display one or more additional symbols;

in response to the one or more additional symbols including a first aggregating symbol, determine a first award value for the first aggregating symbol from the values of a first set of currently displayed symbols, wherein the first set of the currently displayed symbols is determined according to first criteria;

in response to the one or more additional symbols including a second aggregating symbol, determine a second award value for the second aggregating symbol from the values of a second set of the currently displayed symbols, wherein the second set of the currently displayed symbols is determined according to second criteria, the first criteria being different from the second criteria, wherein the electronic display device is further directed to: (i) present a value-indicia watermark indicating a respective value for each symbol of both the first set of currently display symbols and the second of currently display symbols and (ii) present an aggregated value-indicia watermark for each of the first aggregating symbol and the second aggregating symbol that indicates a respective aggregate value at least partially as a function of the respective sum of values, the first aggregating symbol being visually distinguishable from the second aggregating symbol.

14. The gaming system of claim 13, wherein the game-logic circuitry is configured to, in response to the one or more additional symbols including a multiplier aggregating symbol, add a sum of values of a third set of currently displayed symbols multiplied by a designated multiplier value to the multiplier aggregating symbols, the third set being determined according to third criteria.

15. The gaming system of claim 14, wherein the third criteria defines the third set to be the first set, the second set, or both the first and the second sets.

16. The gaming system of claim 13, wherein the game-logic circuitry is configured to hold, spin, and stop at least one of the remaining independent symbol-bearing reels through a predetermined number of spins.

17. The gaming system of claim 16, wherein the one or more additional symbols includes a free-spin symbol, and wherein the occurrence of the free-spin symbol adds at least one additional spin to the remaining number of spins.

18. The gaming system of claim 13, wherein the at least one remaining independent symbol-bearing reel includes all the independent symbol-bearing reels in the array not occupied by the plurality of triggering symbols.

19. The gaming system of claim 13, wherein the first award value is determined by summing the values of the first set.

20. The gaming system of claim 13, wherein the first set is determined to be all the symbols displayed in the array when the first aggregating symbol lands in the array.

* * * * *